US005534877A

United States Patent [19]

Sorbello et al.

[11] Patent Number: 5,534,877

[45] Date of Patent: Jul. 9, 1996

[54] ORTHOGONALLY POLARIZED DUAL-BAND PRINTED CIRCUIT ANTENNA EMPLOYING RADIATING ELEMENTS CAPACITIVELY COUPLED TO FEEDLINES

[75] Inventors: Robert M. Sorbello, Potomac; Amir I. Zaghloul, Bethesda, both of Md.

[73] Assignee: Comsat, Bethesda, Md.

[21] Appl. No.: 126,438

[22] Filed: Sep. 24, 1993

Related U.S. Application Data

[63] Continuation of Ser. No. 855,494, Mar. 23, 1992, abandoned, which is a continuation of Ser. No. 450,770, Dec. 14, 1989, abandoned.

[51] Int. Cl.[6] ..... H01Q 1/38

[52] U.S. Cl. ..... 343/700 MS

[58] Field of Search ..... 343/700 MS, 829, 343/846, 814; H01Q 1/38, 13/08, 21/24

[56] References Cited

U.S. PATENT DOCUMENTS 3,854140 12/1974 Ranghelli et al. ..... 343/814

4,816,835 3/1989 Abiko et al. ..... 343/700 MS 4,926,189 5/1990 Zaghloul et al. ..... 343/700 MS 4,929,959 5/1990 Sorbello et al. ..... 343/700 MS

FOREIGN PATENT DOCUMENTS 2219143 11/1989 United Kingdom ..... H01Q 21/00

*Primary Examiner*—Michael C. Wimer

*Attorney, Agent, or Firm*—Sughrue, Mion, Zinn, Macpeak & Seas

[57] ABSTRACT

A dual polarized printed circuit antenna operating in dual frequency bands. A first array of radiating elements radiates at a first frequency, and a second array of radiating elements radiates at a second, different frequency. Separate power divider arrays are provided for each array of radiating elements, and the overall structure is provided in a stacked configuration.

4 Claims, 8 Drawing Sheets

DUAL FREQUENCY GEOMETRY

DUAL FREQUENCY GEOMETRY

CO AND CROSS-POL
RADIATION PATTERN
11.95 GHz

CO AND CROSS-POL
RADIATION PATTERN
14.25 GHz

ORTHOGONALLY POLARIZED DUAL-BAND PRINTED CIRCUIT ANTENNA EMPLOYING RADIATING ELEMENTS CAPACITIVELY COUPLED TO FEEDLINES

This is a Continuation of application Ser. No. 07/855,494 filed Mar. 23, 1992, abandoned, which is a Continuation of application Ser. No. 07/450,770 filed Dec. 14, 1989 abandoned.

BACKGROUND OF THE INVENTION

This invention relates to another improvement in a series of inventions developed by the present inventors relating to printed circuit antennas having their elements capacitively coupled to each other, and in particular, two antennas wherein the feed to the radiating elements is coupled capacitively, rather than directly. The first in this series of inventions, invented by one of the present inventors, resulted in U.S. Pat. No. 4,761,654. An improvement to the antenna disclosed in that patent is described and claimed in U.S. patent application Ser. No. 06/930,187, filed on Nov. 13, 1986, now U.S. Pat. No. 5,005,019. The contents of the foregoing patents are incorporated herein by reference.

The antenna described in the foregoing U.S. patent and patent application permitted either linear or circular polarization to be achieved with a single feedline to the radiating elements. The antennas disclosed included a single array of radiating elements, and a single array of feedlines. One of the improvements which the inventors developed was to provide a structure whereby two layers of feedlines, and two layers of radiating elements could be provided in a single antenna, enabling orthogonally polarized signals to be generated, without interference between the two arrays. U.S. patent application Ser. No. 07/165,332, now U.S. Pat. No. 4,929,959 discloses and claims such a structure. The contents of that patent also are incorporated herein by reference.

Having developed the dual-band orthogonally polarized antenna, various experiments have been conducted with different shapes of radiating elements, and antenna configurations. Commonly assigned application Ser. No. 07/192,100, now U.S. Pat. No. 4,926,189 is directed to such an array employing gridded antenna elements. The contents of that patent also are incorporated herein by reference.

The work on dual polarized printed antennas resulted in the provision of an array which could operate in two senses of polarization, a lower array of the antenna being able basically to "see through" the upper array. The improvement represented by the present invention is to extend that concept.

SUMMARY OF THE INVENTION

In view of the foregoing, it is one object of the present invention to provide a high-performance, light weight, low-cost dual-band planar array. The inventors have determined that employing certain types of antenna elements for the upper and lower arrays enables operation at two different, distinct frequency bands from a single radiating array structure.

DETAILED DESCRIPTION OF THE PREFERRED EMBODIMENT

Figure 1:
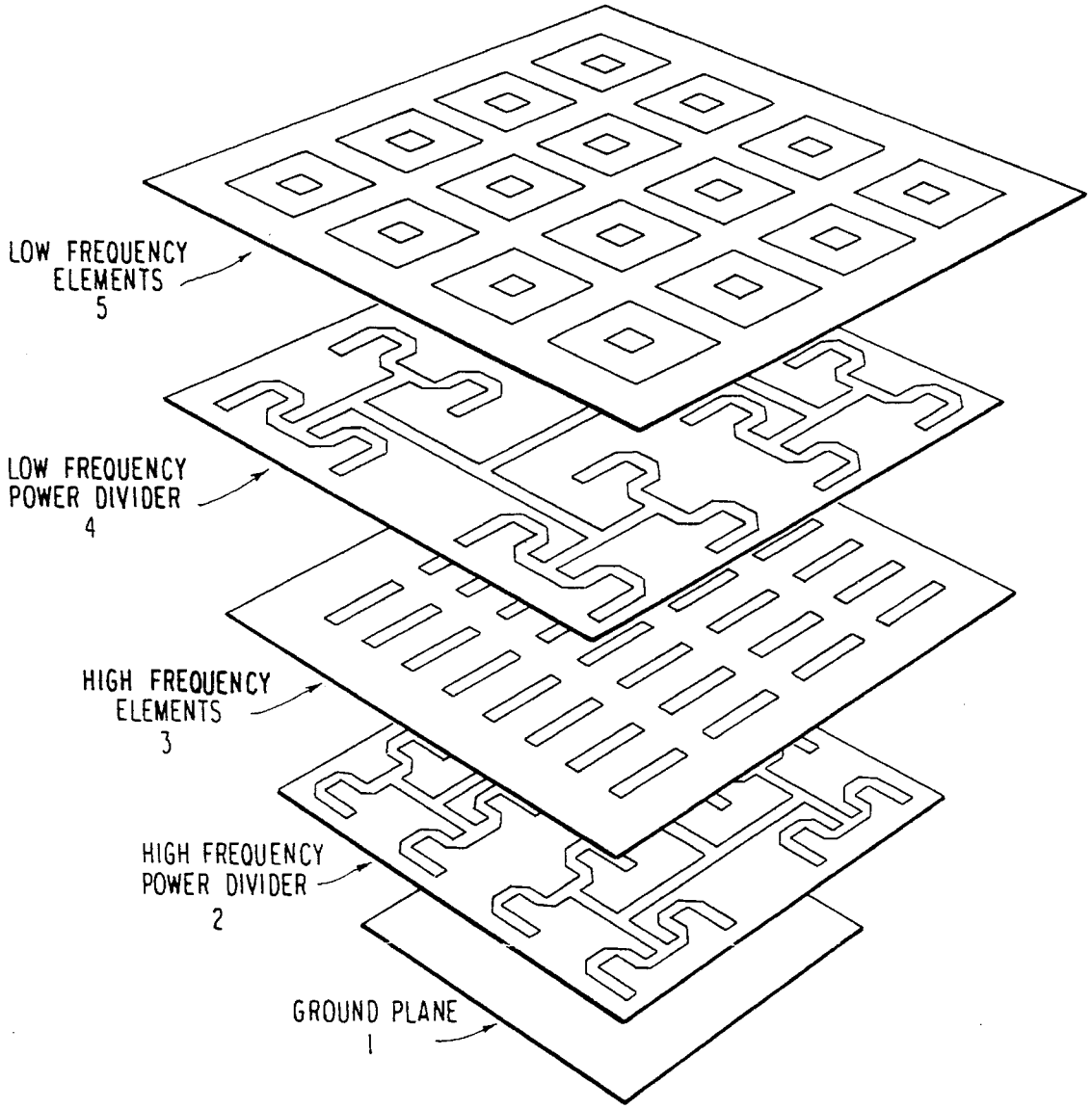
FIG. 1 shows an exploded view of the dual frequency antenna of the invention.

Referring to FIG. 1, the inventive structure, as described also in U.S. Pat. Nos. 4,929,959 and 4,926,189, comprises five layers. The first layer is a ground plane 1. The second layer is a high frequency power divider 2, with the individual power divider elements disposed at a first orientation. The next layer is an array of high frequency radiating elements 3. These three layers together define the first operating band array B1, in which layers 1 and 3 form the ground plane for the power divider 2.

The operating frequency of the array is dictated by the dimensions of the radiating elements and the power distribution network. The array of high frequency elements 3 will have physically smaller radiating slots than those used in the low frequency array. The principal controlling factor in the resonant frequency of the slot is the outer dimension (radius or side) of the element. This dimension is inversely proportional to the operating frequency. As a rule of thumb, for a circularly-shaped element, the diameter is approximately one-half of the operating wavelength; for a square or rectangularly-shaped element, a side (longer side for a rectangle) is approximately one-half the operating wavelength. Those of working skill in this field will appreciate that the actual dimensions may vary somewhat, according to the earlier-stated prescriptions.

The power divider 2 may consist of impedance transforming sections at the tee junctions where the power split is performed. These transforming sections typically are $\lambda/4$ in length, where $\lambda$ refers to the wavelength at the operating frequency. The transformer length also will be inversely proportional to the operating frequency.

Disposed above the high frequency elements 3 is a low frequency power divider array 4, with the individual power divider elements disposed orthogonally with respect to the elements of the power divider 2. Above the low frequency power divider 4 is a second array of radiating elements 5, these elements 5 being low frequency radiating elements. The layers 3–5 together form a second operating band array B2, wherein the layers 3 and 5 provide the ground plane for the power divider 4. The element designs in layers 3 and 5 are designed appropriately to minimize both radiation interaction between the lower and upper arrays, and coupling between the two power distribution networks.

As discussed previously, the physical size of the elements in the layer 5 will determine the operating frequency. The elements of the low frequency array 5 will be larger than those of the high frequency array 3. Transformer sections within the low-frequency power divider network will be longer than those used in the high frequency divider, but otherwise the divider networks may be very similar in design.

All of the layers 1–5 may be separated by any suitable dielectric, preferably air, for example by providing Nomex honeycomb between the layers.

The structure depicted in FIG. 1 shows the design and construction for a dual-band linearly polarized flat-plate array. Linear polarization is dictated by the radiating elements. Circular polarization may be generated by choosing the appropriate elements with perturbation segments as described, for example, in U.S. Pat. No. 5,005,019. U.S. Pat. No. 4,929,959 also shows examples of such elements.

Figure 2:
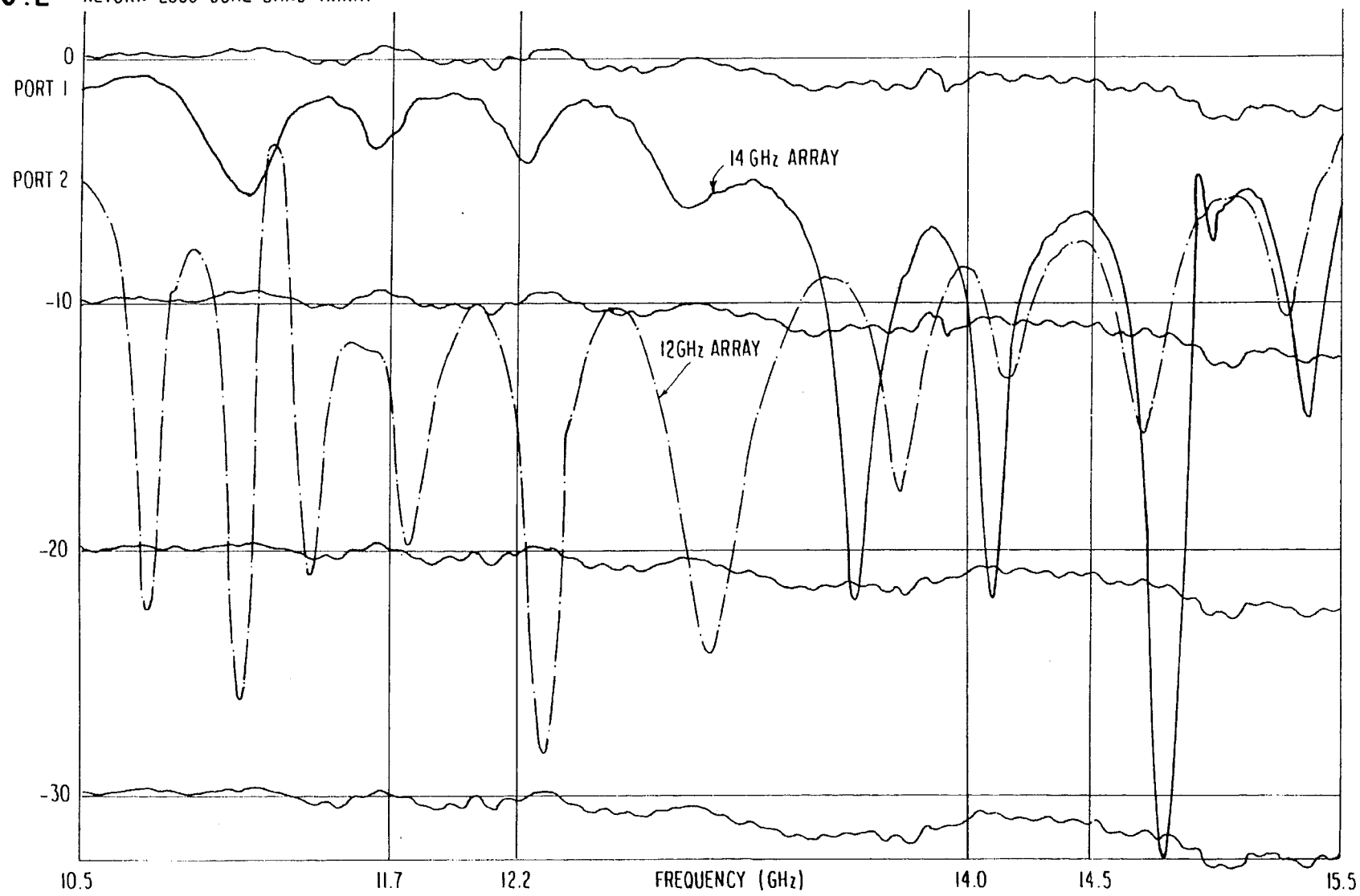
FIGS. 2–8 show graphs of the measured performance of a sixteen-element dual band array.
Figure 3:
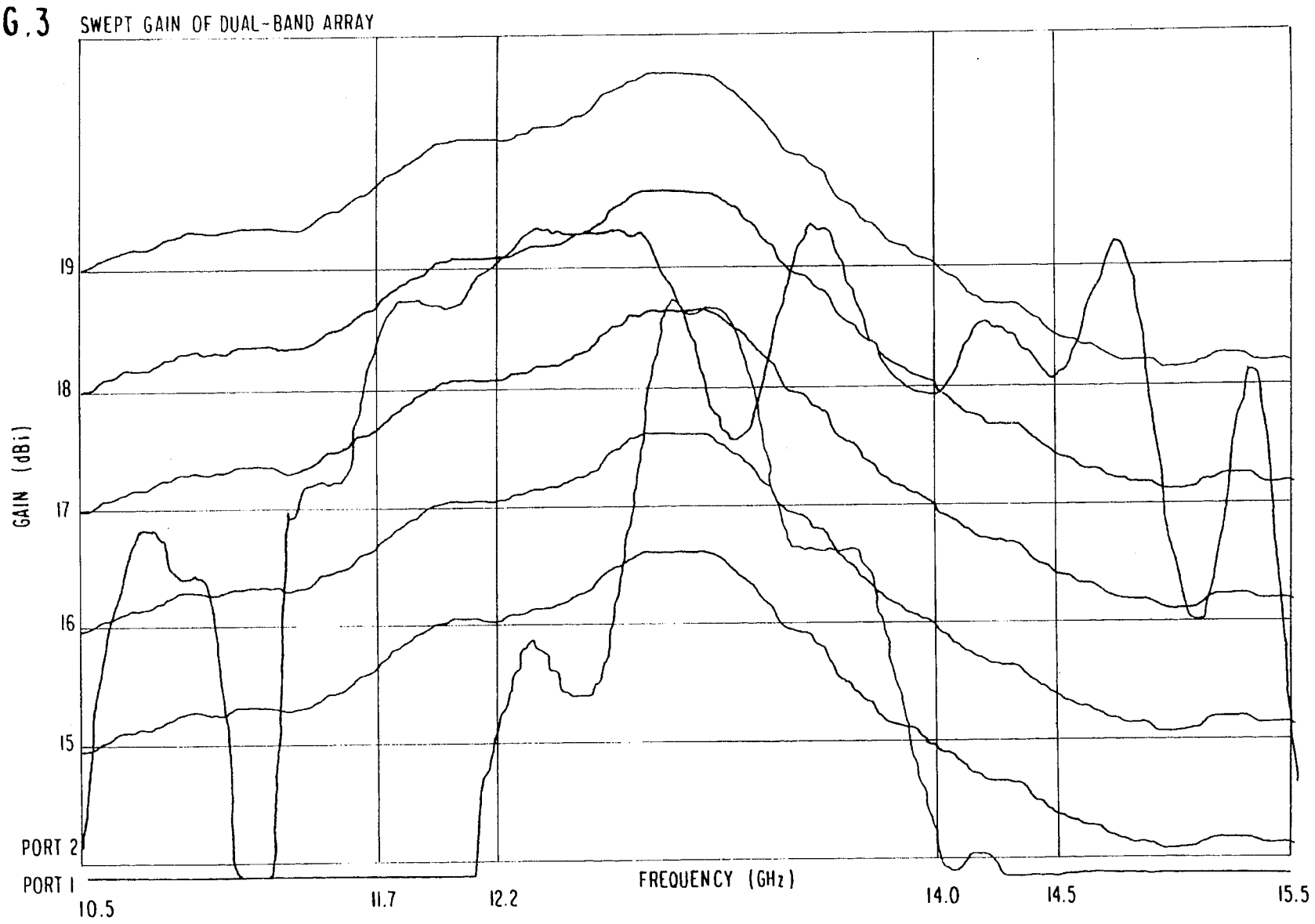

The measured performance of a 16-element dual band linear array is depicted in FIGS. 2–8. For one sense of polarization, the band of interest is 11.7–12.2 GHz, and for the other, orthogonal sense of polarization, the band of interest is 14.0–14.5 GHz. FIG. 2 shows the input return loss for both senses of polarization (in each instance, the input match is very good over a broad band, as can be seen from the figure). FIG. 3 shows the corresponding radiation gain for each polarization. As shown in the Figure, both senses of polarization radiate very efficiently and over a broad band, and the radiation efficiency of each is comparable. For port 2, the gain (dBi) within the 11.7–12.2 GHz band is at least 3 dB higher than that for port 1. For port 1, the gain within the 14.0–14.5 GHz band is at least 3 dB higher than that for port 2.

Figure 4:
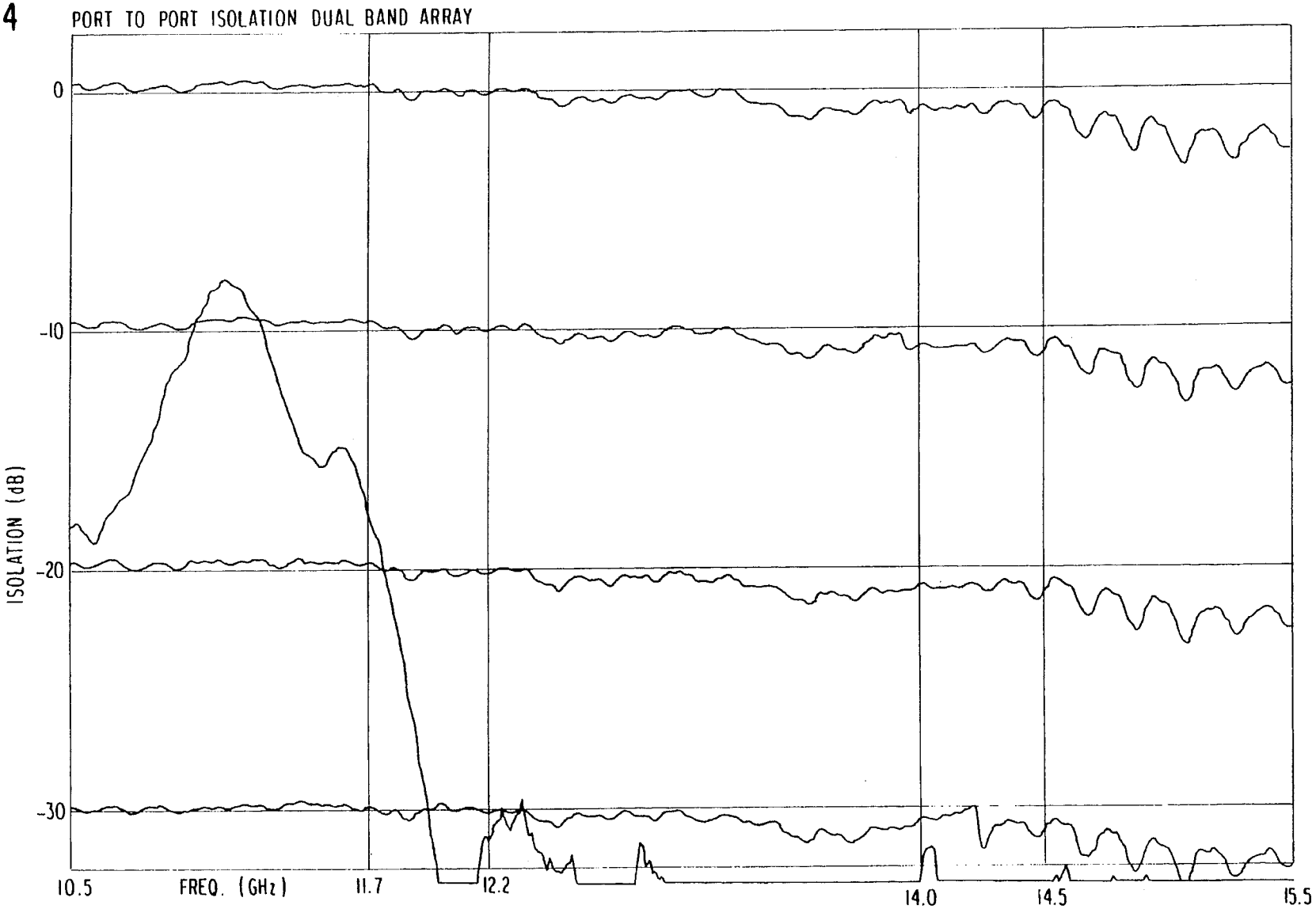
Figure 5:
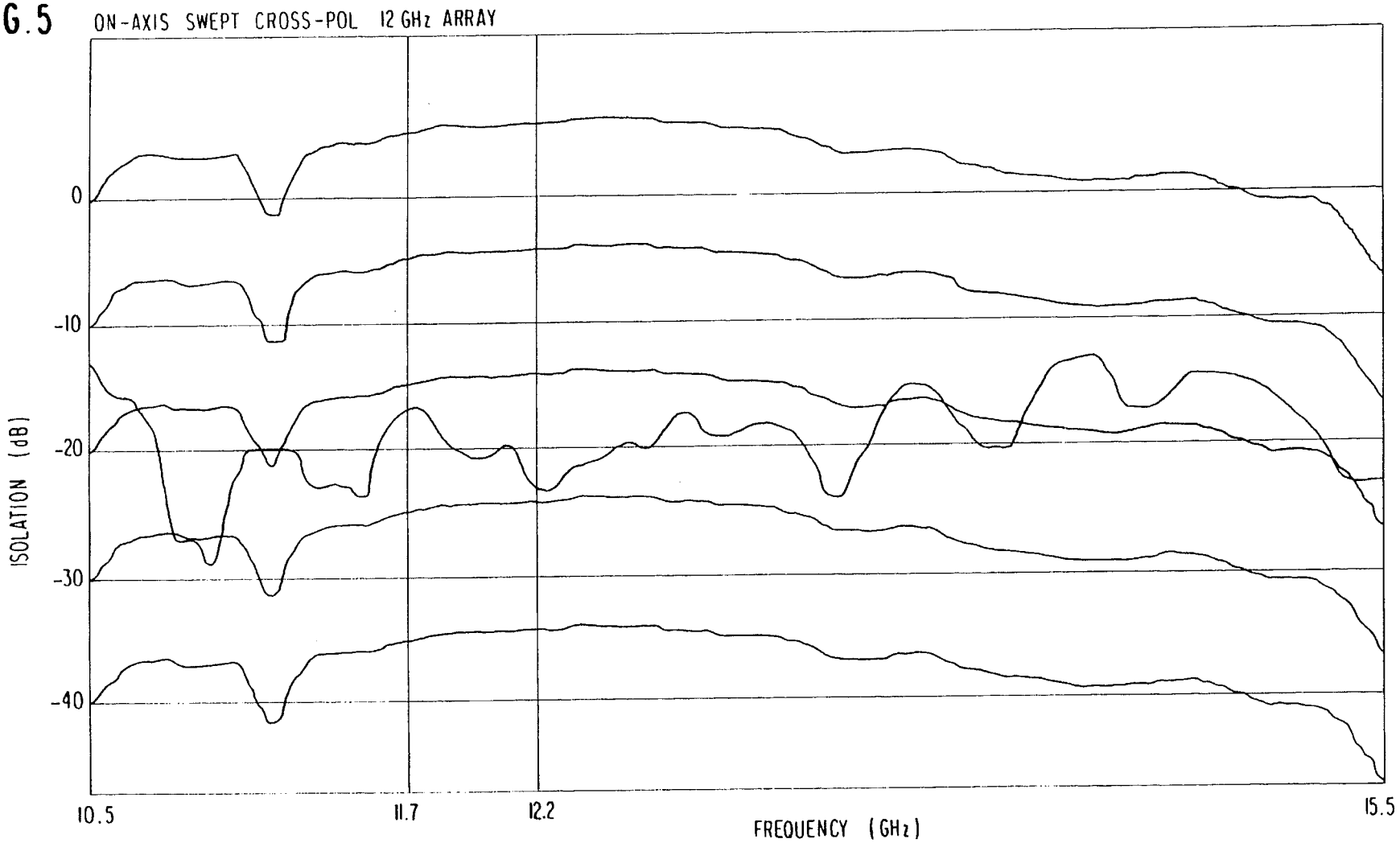
Figure 6:
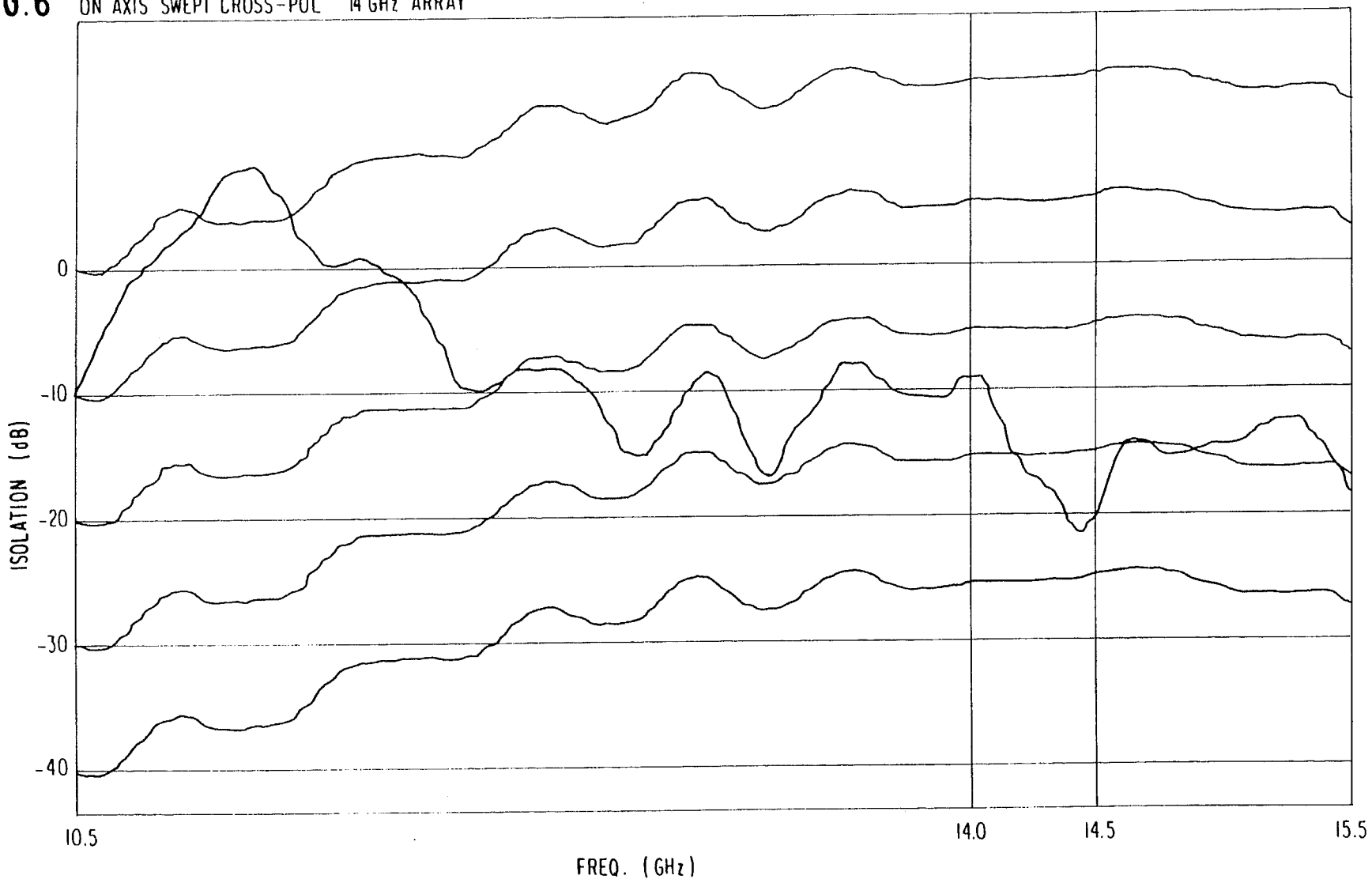
Figure 7:
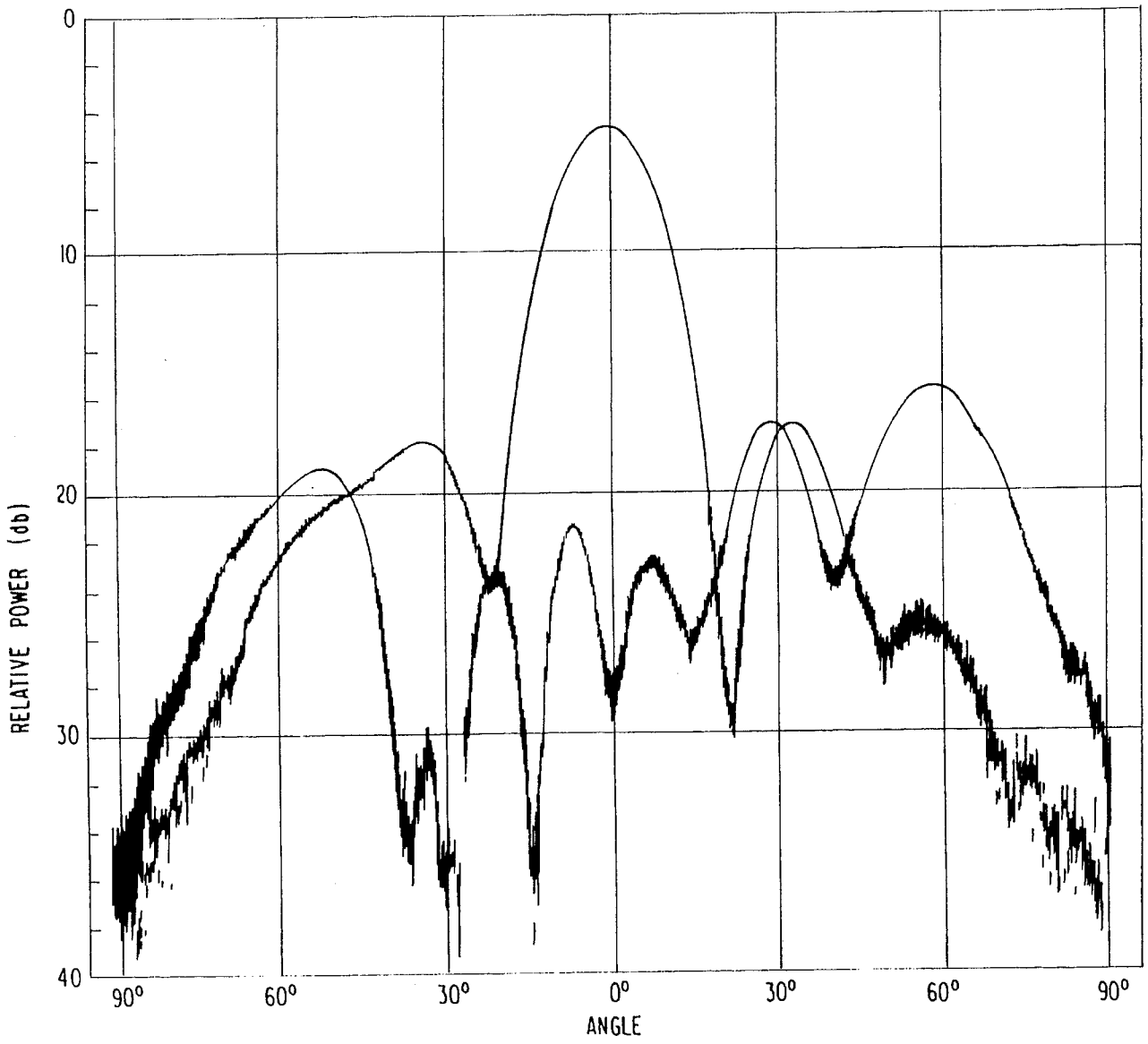
Figure 8:
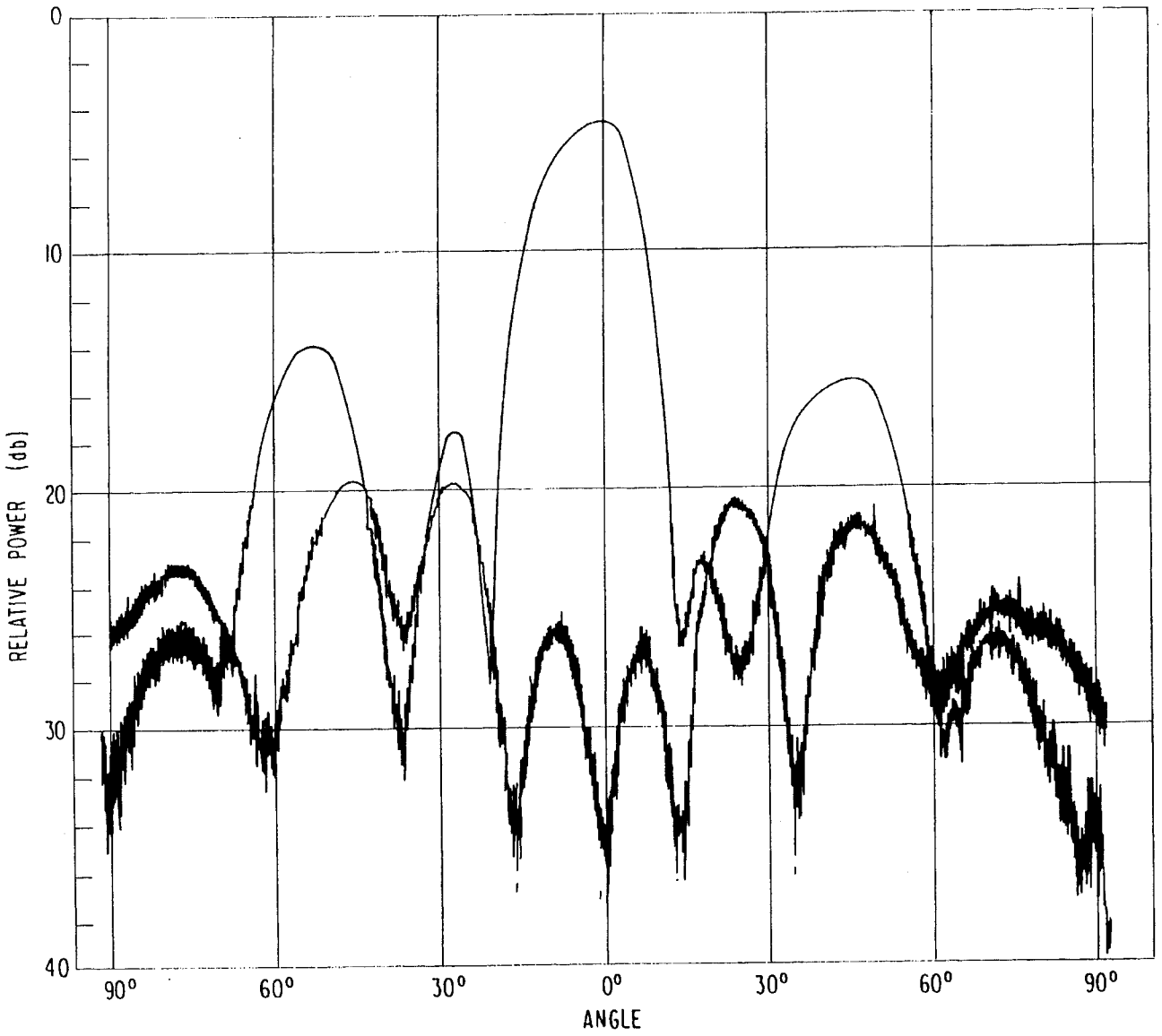

FIG. 4 shows the port-to-port or array network isolation. The isolation is sufficiently high to ensure that the two arrays are virtually decoupled, and operate as required in an independent manner. FIGS. 5–8 show a corresponding on axis swept cross polarization and radiation patterns for each frequency band, demonstrating the efficiency of the radiating array, and the low radiated cross polarization.

While the invention has been described with reference to a particular preferred embodiment, various modifications within the spirit and scope of the invention will be apparent to those of working skill in this technical field. For example, although the foregoing measured data shown in the figures was provided with respect to specific frequency bands, the invention represents a design that can be implemented for any two distinct frequency bands, and for any size array or any number of elements. Thus, the invention should be considered limited only by the scope of the appended claims.

What is claimed is:

1. In a dual polarized printed antenna comprising a ground plane, a first power divider array disposed over said ground plane, a first array of radiating elements disposed over said first power divider array, a second power divider array disposed over said first array of radiating elements, and a second array of radiating elements disposed over said second power divider array, the improvement wherein said first array of radiating elements comprises an array of radiating elements having a first size and being so configured as to operate within a first frequency band, and said second array of radiating elements comprises an array of radiating elements having a second size that is larger than said first size and being so configured as to operate within a second frequency band that is at least 1 GHz lower than said first frequency band, and wherein said second array of radiating elements have a gain that is at least 4.0 dB less than a gain of said first array of radiating elements throughout said first frequency band, and said first array of radiating elements have a gain that is at least 4.0 dB less than a gain of said second array of radiating elements throughout said second frequency band.

2. An antenna as claimed in claim 1, wherein said first and second power divider arrays comprise respective power divider arrays for feeding said first and second arrays of radiating elements at frequencies within said first and second frequency bands, respectively.

3. An antenna as claimed in claim 1, wherein the impedance transforming sections of said second power divider array are longer than the impedance transforming sections of said first power divider array.

4. An antenna as claimed in claim 1, wherein said first frequency band is 14.0–14.5 GHz, and said second frequency band is 11.7–12.2 GHz.

* * * * *